US010683757B2

(12) United States Patent
Kim et al.

(10) Patent No.: US 10,683,757 B2
(45) Date of Patent: Jun. 16, 2020

(54) DISK ASSEMBLY AND TURBINE INCLUDING THE SAME

(71) Applicant: Doosan Heavy Industries & Construction Co., Ltd., Changwon-si, Gyeongsangnam-do (KR)

(72) Inventors: Kyung Kook Kim, Daejeon (KR); Tae Sung Ahn, Seoul (KR); Mu Hyoung Lee, Changwon-si (KR); Ki Baek Kim, Daejeon (KR); Sung Chul Jung, Daejeon (KR)

(73) Assignee: Doosan Heavy Industries Construction Co., Ltd, Gyeongsangnam-do (KR)

( * ) Notice: Subject to any disclaimer, the term of this patent is extended or adjusted under 35 U.S.C. 154(b) by 390 days.

(21) Appl. No.: 15/644,464

(22) Filed: Jul. 7, 2017

(65) Prior Publication Data

US 2018/0010461 A1 Jan. 11, 2018

(30) Foreign Application Priority Data

Jul. 7, 2016 (KR) ..... 10-2016-0086135
Jul. 7, 2016 (KR) ..... 10-2016-0086136
Jul. 7, 2016 (KR) ..... 10-2016-0086137

(51) Int. Cl.
*F01D 5/08* (2006.01)
*F01D 5/06* (2006.01)

(52) U.S. Cl.
CPC ..... *F01D 5/081* (2013.01); *F01D 5/066* (2013.01); *F01D 5/085* (2013.01); *F05D 2260/31* (2013.01); *F05D 2260/402* (2013.01); *F05D 2260/403* (2013.01)

(58) Field of Classification Search
CPC ..... F01D 5/081; F01D 5/066; F01D 5/085; F05D 2260/31; F05D 2260/402; F05D 2260/403
See application file for complete search history.

(56) References Cited

U.S. PATENT DOCUMENTS 7,585,148 B2 9/2009 Hoell
2010/0143149 A1* 6/2010 Benkler ..... F01D 5/066 416/244 A
2010/0166559 A1* 7/2010 Ahaus ..... F01D 5/066 416/198 A

FOREIGN PATENT DOCUMENTS

EP 0894942 A2 2/1999
EP 3176366 A1 6/2017
JP 2007-529668 A 10/2007
JP 2010-520967 A 6/2010
JP 2014-009688 A 1/2014
KR 10-1509382 B1 4/2015

* cited by examiner

*Primary Examiner* — Xiao En Mo
(74) *Attorney, Agent, or Firm* — INVENSTONE Patent, LLC

(57) ABSTRACT

A disk assembly may include: a first disk engaged with a compressor section of a gas turbine; a second disk engaged with a turbine section of the gas turbine; and a third disk disposed between the first and second disks, and transferring torque applied to the second disk to the first disk. The third disk has a plurality of legs formed on an inner circumferential surface thereof, the plurality of legs being in contact with an outer circumferential surface of a tie bolt of the gas turbine.

20 Claims, 11 Drawing Sheets

[FIG. 1]
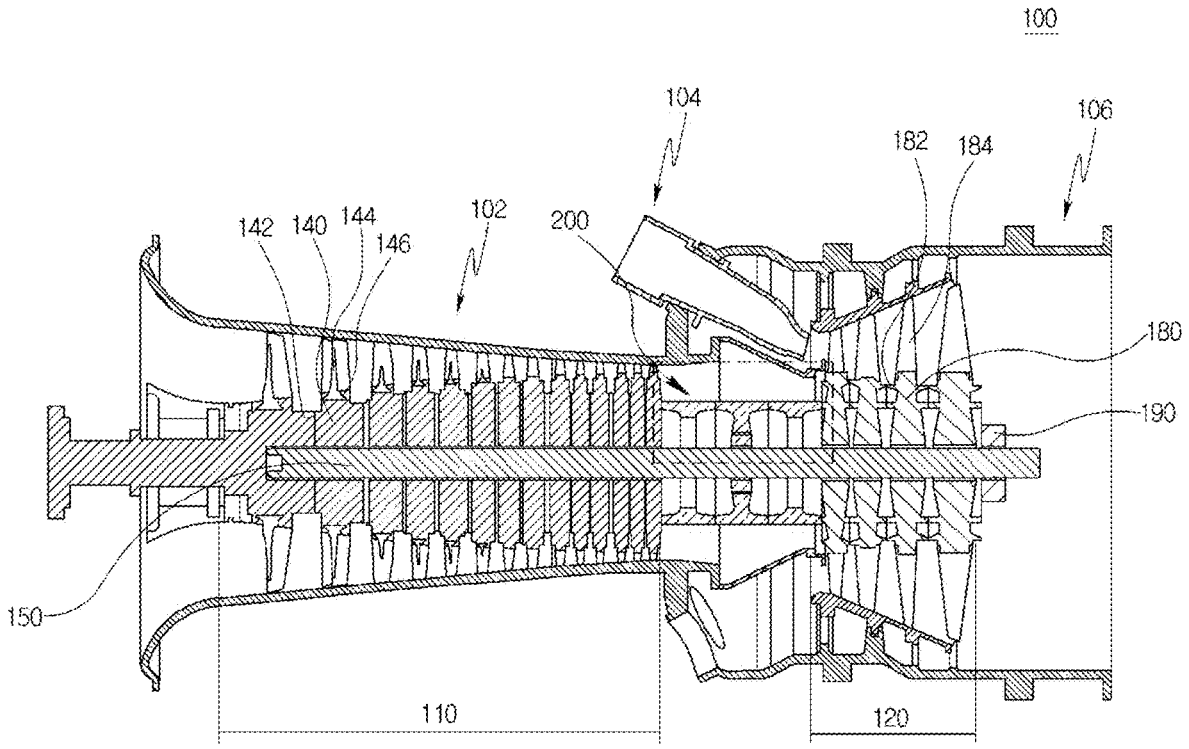

[FIG. 2]
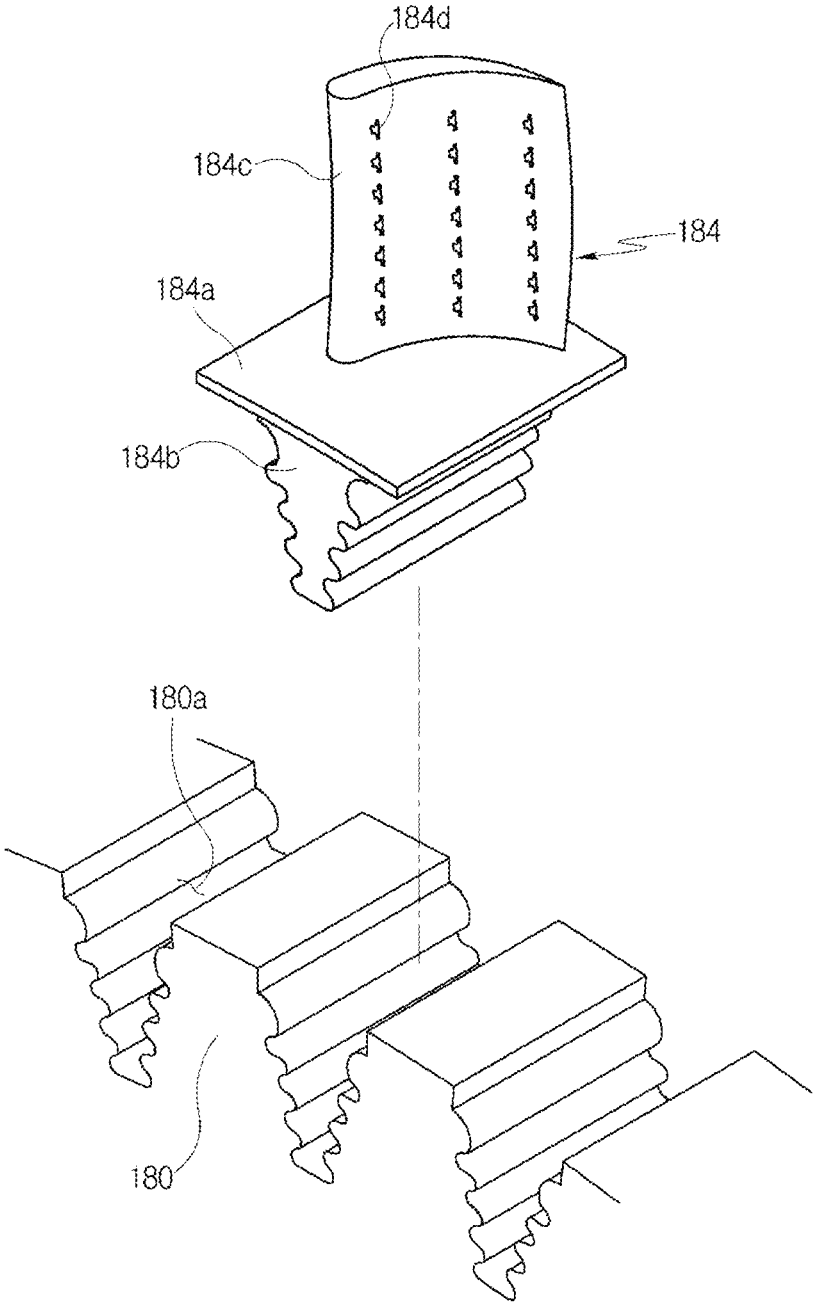

[FIG. 3]
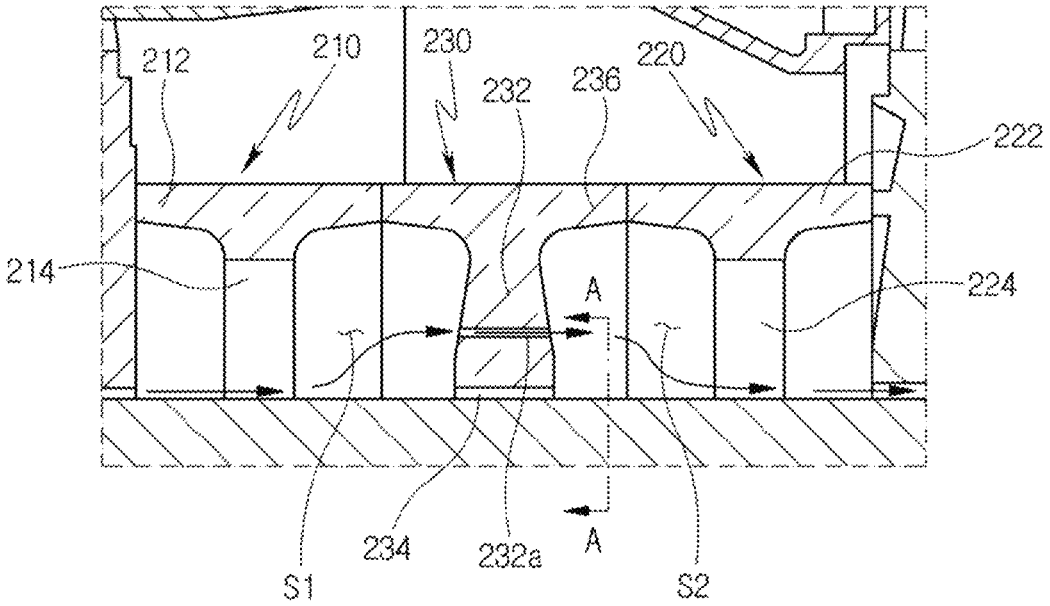

[FIG. 4]
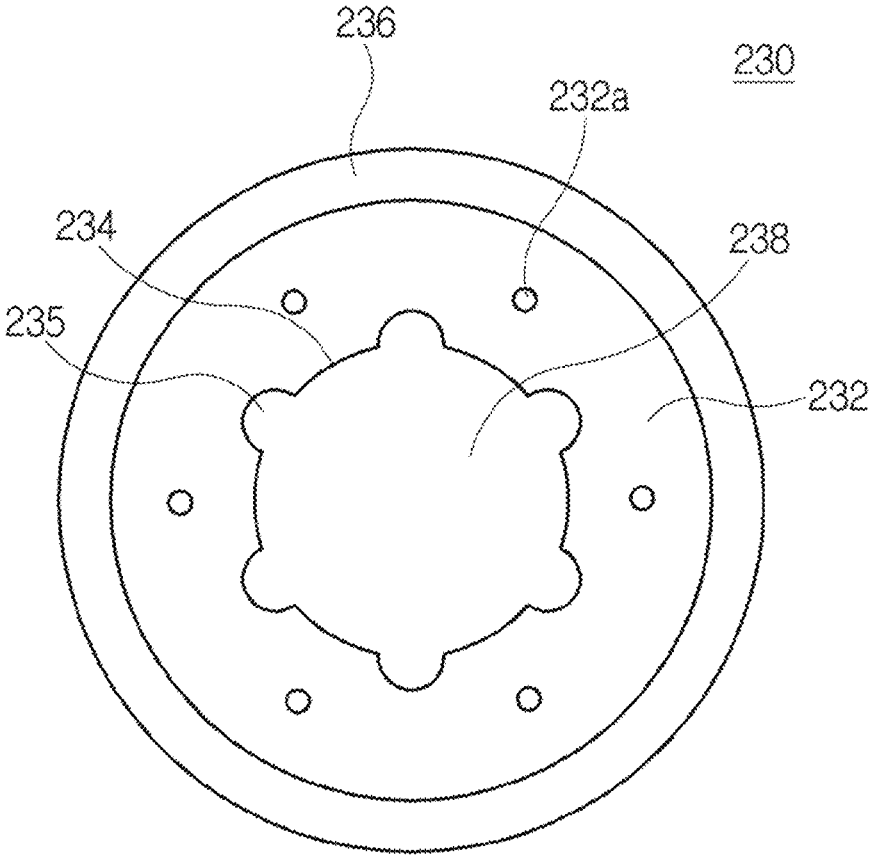

[FIG. 5]
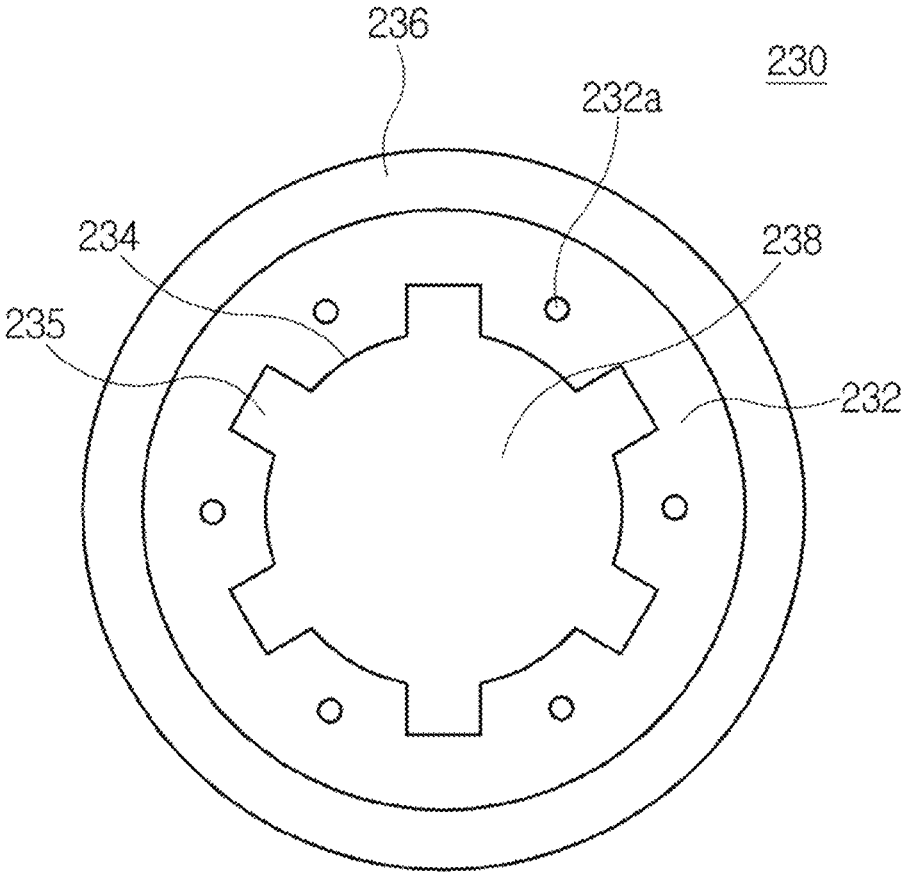

[FIG. 6]
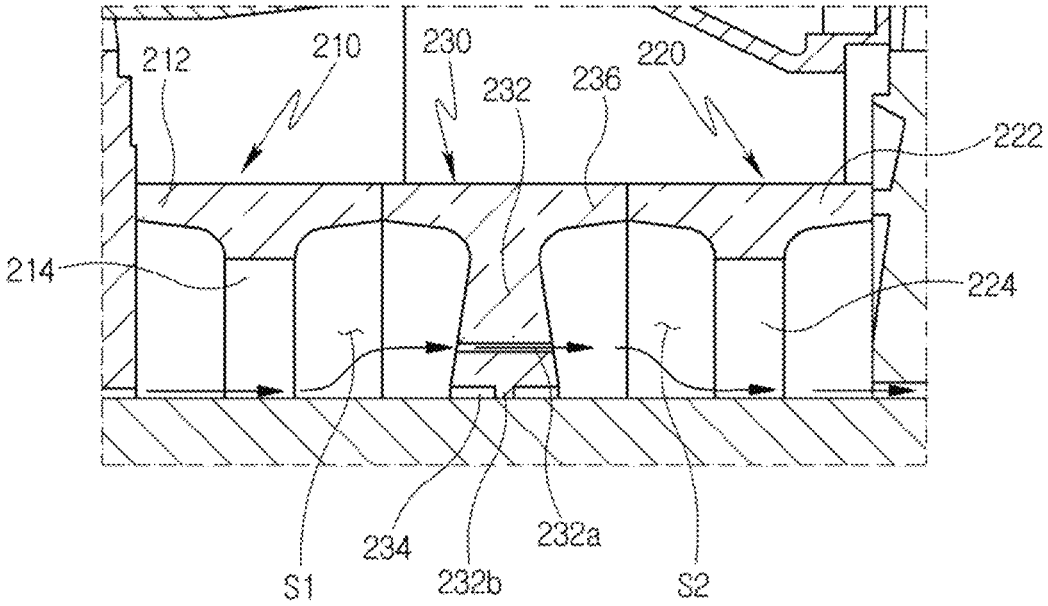

[FIG. 7]
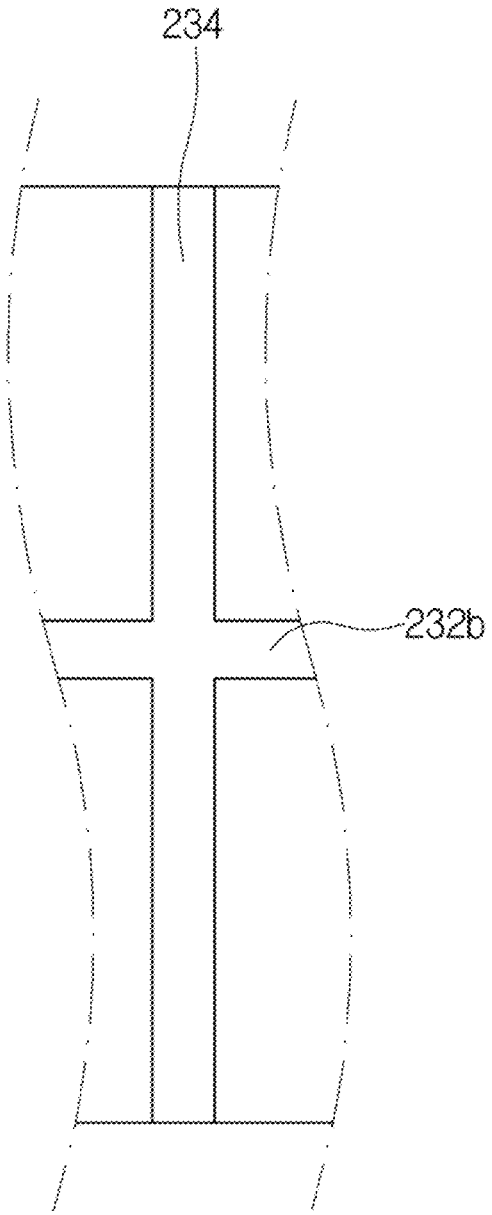

[FIG. 8]
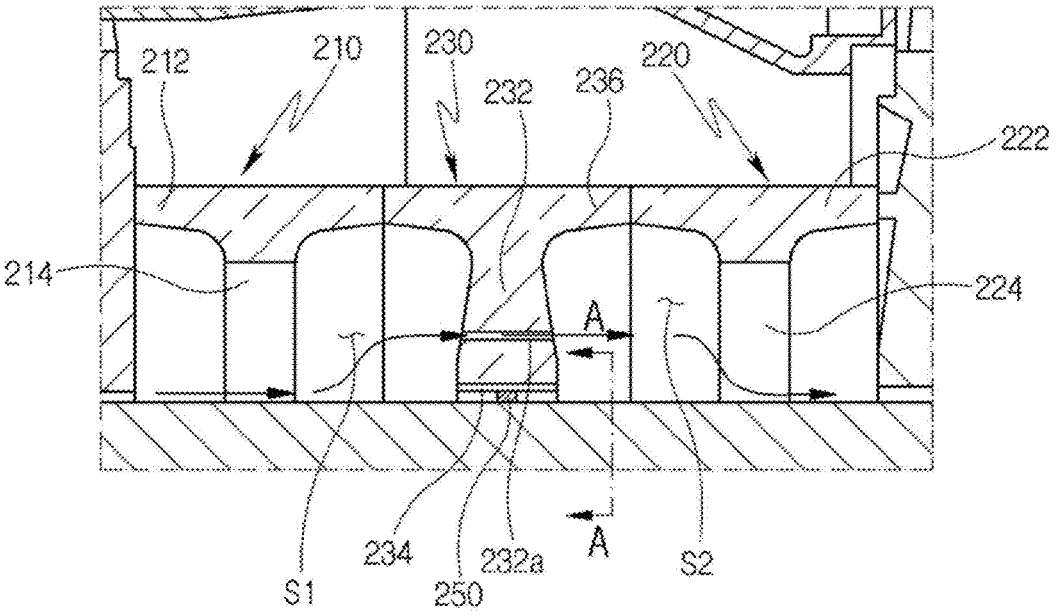

[FIG. 9]
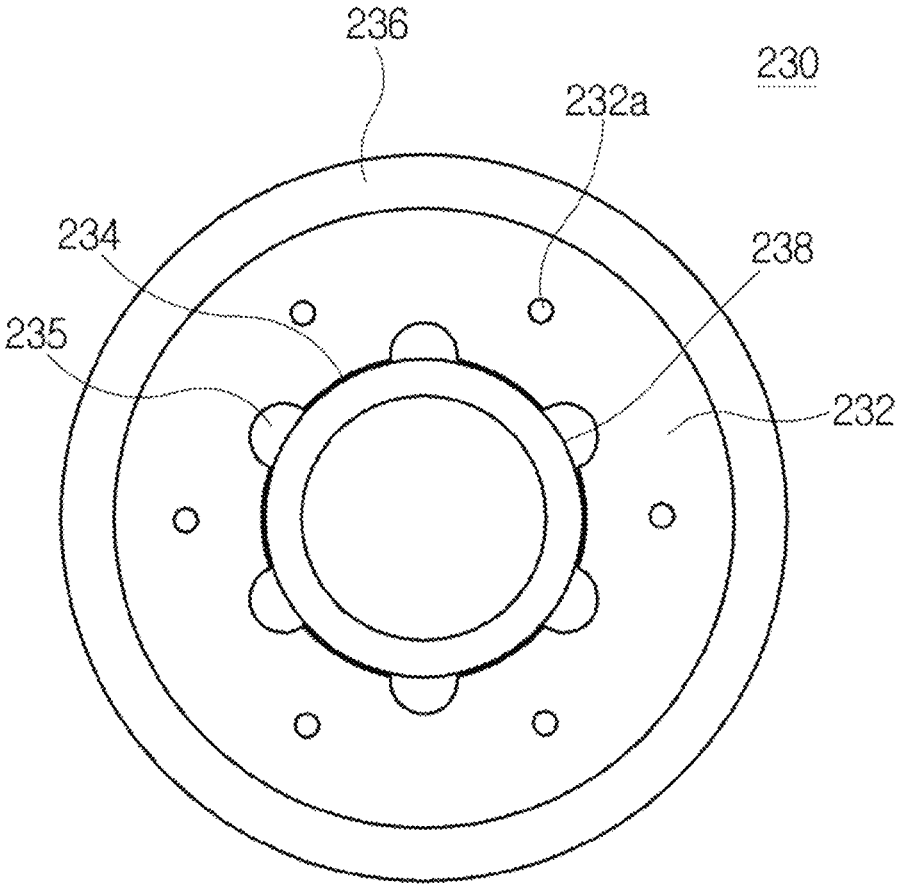

[FIG. 10]
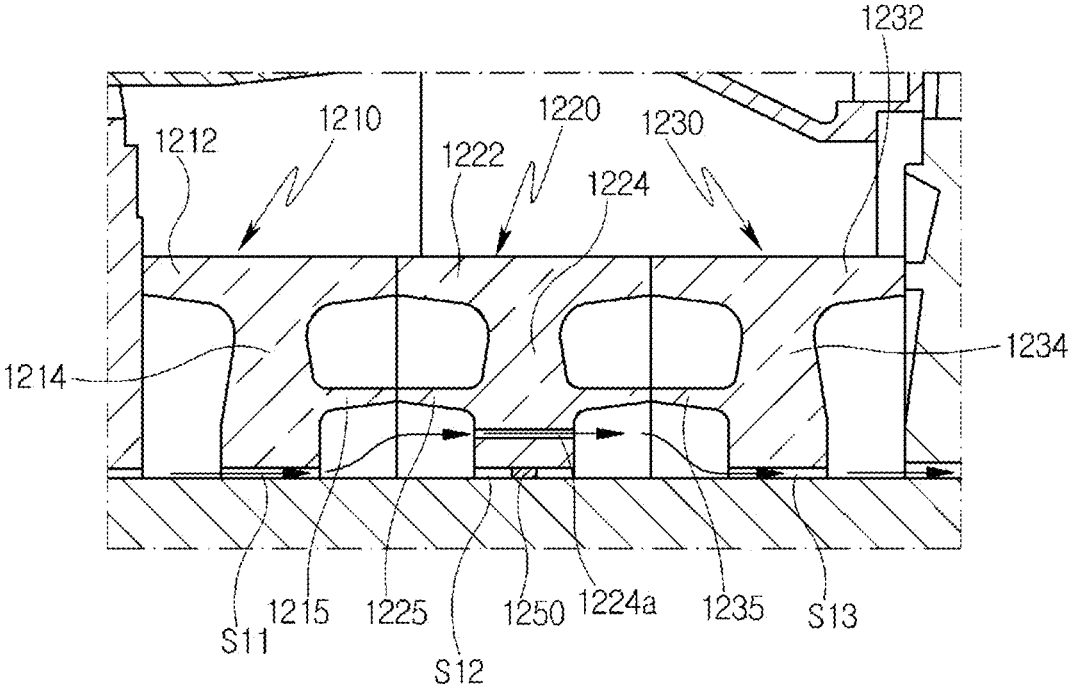
[FIG. 11]
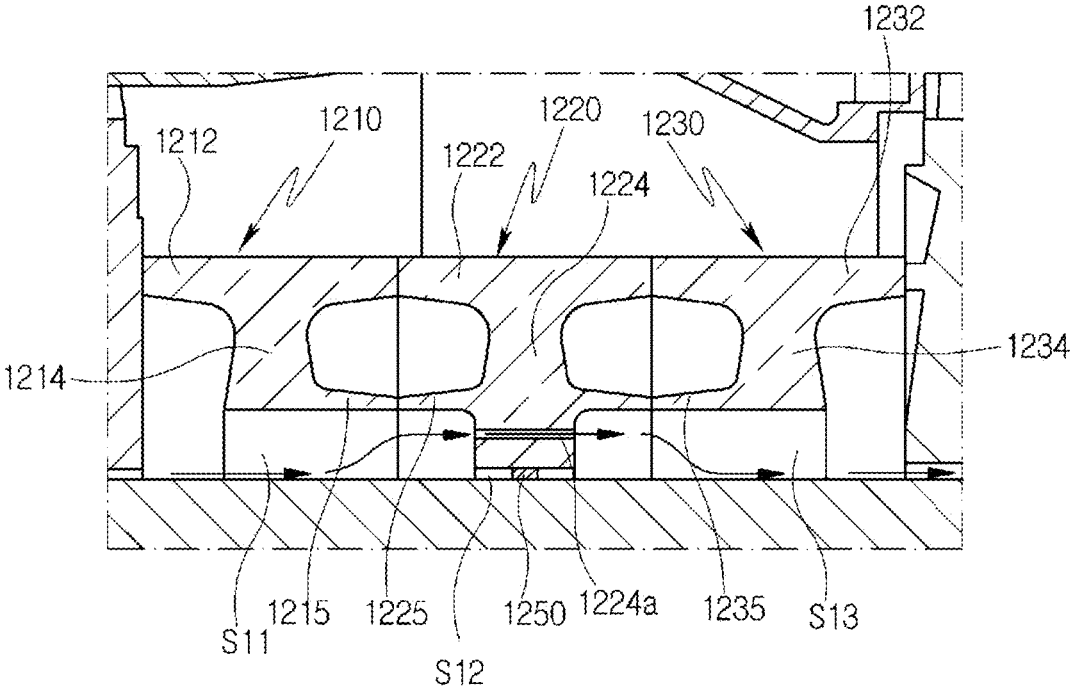

[FIG. 12]
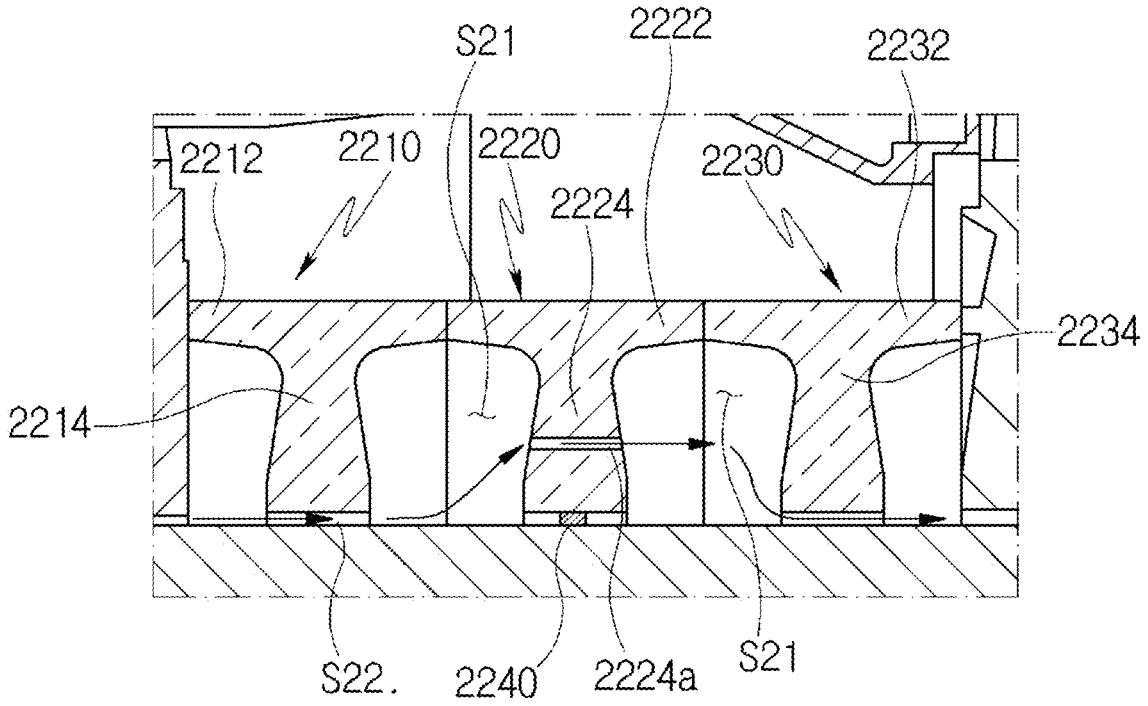
[FIG. 13]
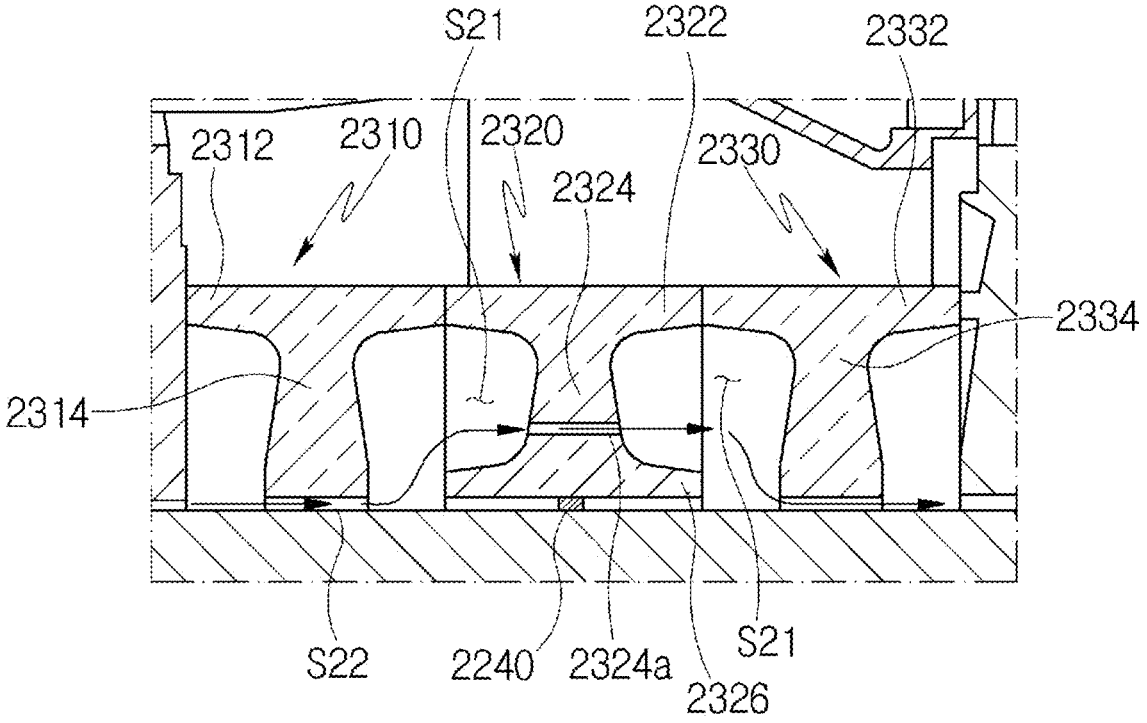

DISK ASSEMBLY AND TURBINE INCLUDING THE SAME

CROSS-REFERENCES TO RELATED APPLICATIONS

This application claims priority to Korean Patent Application Nos. 10-2016-0086135, filed on Jul. 7, 2016; 10-2016-0086136, filed on Jul. 7, 2016; and 10-2016-0086137, filed on Jul. 7, 2016, the disclosures of which are incorporated herein by reference in their entirety.

BACKGROUND OF THE INVENTION

Field of the Invention

Exemplary embodiments of the present invention relate to a disk assembly and a turbine including the same and, more particularly, to a disk assembly which is disposed between a compressor section and a turbine section in a turbine or specifically a gas turbine, and transfers torque generated by the turbine section to the compressor section, and a turbine including the same.

Description of the Related Art

A gas turbine is a kind of motor that generates torque by injecting combustion gas toward blades of a turbine, and may be roughly divided into a compressor, a combustor and the turbine. The compressor serves to receive a part of power generated by rotations of the turbine, and compress introduced air at high pressure, and the compressed air is transferred to the combustor.

The combustor mixes the compressed air and fuel, generates a high-temperature combustion gas flow by combusting the fuel mixture, and injects the high-temperature combustion gas toward the turbine, and the injected combustion gas can rotate the turbine to generate torque.

The compressor and the turbine include a plurality of rotor disks each having blades radially coupled to the outer circumference thereof. Typically, the compressor includes a larger number of rotor disks than the turbine. Hereafter, the plurality of rotor disks arranged in the compressor is referred to as a compressor section, and the plurality of rotor disks arranged in the turbine is referred to as a turbine section.

The rotor disks are fastened to each other so as to rotate with the adjacent rotor disks. Furthermore, the rotor disks are closely fixed to each other by a tie bolt so as not to move in the axial direction.

The tie bolt may be inserted through the centers of the rotor disks, and pressure nuts may be fastened to both ends of the tie bolt such that the rotor disks do not move in the axial direction.

Since the combustor is disposed between the compressor section and the turbine section, the compressor section and the turbine section are separated from each other to form a space for the combustor. Since the tie bolt restricts only the axial movements of the rotor disks, the rotor disks can freely rotate about the tie bolt. Therefore, a torque transfer member needs to be additionally installed to transfer torque generated by the turbine section to the compressor section through the combustor.

Examples of the torque transfer member may include a torque tube. The torque tube is formed in a hollow cylinder shape, and has both ends fastened to the last rotor disk of the compressor section and the first rotor disk of the turbine section, respectively, in order to transfer torque therebetween.

The torque tube must be resistant to deformation and distortion because the gas turbine is continuously operated for a long term. Furthermore, the torque tube must be easily assembled and disassembled to facilitate maintenance. In addition, since the torque tube also functions as an air flow path for transferring cooling air supplied from the compressor section to the turbine section, the torque tube must be able to smoothly supply the cooling air.

SUMMARY OF THE INVENTION

The present invention has been made in view of the above problems, and the present invention provides a torque transfer unit which is enhanced more than a conventional torque tube.

Also, the present invention provides a turbine having the above-described torque transfer unit.

Other aspects of the present invention can be understood by the following description, and become apparent with reference to the embodiments of the present invention. Also, it is obvious to those skilled in the art to which the present invention pertains that the benefits of the present invention can be realized by the means as claimed and combinations thereof.

In accordance with one aspect of the present invention, a disk assembly may comprise: a first disk engaged with a compressor section of a gas turbine; a second disk engaged with a turbine section of the gas turbine; and a third disk disposed between the first and second disks, and transferring torque applied to the second disk to the first disk. Each of the first to third disks may comprise a disk body through which a tie bolt of the gas turbine passes, and an outer rim formed on an outer circumference of the disk body and coupling the disks to each other such that the disks cannot rotate relative to each other. The disk body of the third disk may have first and second spaces formed at both sides thereof, and the first and second spaces may communicate with each other through a through-hole formed in the disk body of the third disk.

In accordance with another aspect of the present invention, there is provided a disk assembly comprising first to third disks coupled to each other along an axial direction of a tie bolt so as not to rotate relative to each other. The first and second disks may have a gap with the tie bolt, and the third disk may have a through-hole which is formed therethrough and not in contact with the tie bolt. The gaps of the first and second disks and the through-hole of the third disk may provide a cooling air flow path passing through the first to third disks.

In accordance with yet another aspect of the present invention, a gas turbine may comprise: a housing having a diffuser installed at one end thereof a compressor section disposed in the housing; a turbine section disposed in the housing; a tie bolt rotatably supporting the compressor section and the turbine section; and a disk assembly disposed between the compressor section and the turbine section, and transferring torque generated by the turbine section to the compressor section. The disk assembly may comprise: a first disk engaged with the compressor section; a second disk engaged with the turbine section; and a third disk disposed between the first and second disks, and transferring torque applied to the second disk to the first disk. Each of the first to third disks may comprise a disk body through which the tie bolt passes, and an outer rim formed on an outer circumference of the disk body and coupling the disks to each other such that the disks cannot rotate relative to each other. First and second spaces may be formed at both sides of the disk body of the third disk, communicate with each other through a through-hole formed in the disk body of the third disk, and form a cooling air flow path extended from the compressor section to the turbine section.

It is to be understood that both the foregoing general description and the following detailed description of the present invention are exemplary and explanatory and are intended to provide further explanation of the invention as claimed.

BRIEF DESCRIPTION OF THE DRAWINGS

The above and other features of the present invention will be more clearly understood from the following detailed description taken in conjunction with the accompanying drawings, in which:

FIG. 1 is a cross-sectional view schematically illustrating an internal structure of a gas turbine to which a disk assembly in accordance with a first embodiment of the present invention is applied;

FIG. 2 is an exploded perspective view of a turbine rotor disk of FIG. 1;

FIG. 3 is an expanded cross-sectional view of the first embodiment illustrated in FIG. 1;

FIG. 4 is a cross-sectional view taken along the line A-A' of FIG. 3;

FIG. 5 illustrates a modification of the first embodiment, corresponding to FIG. 4;

FIG. 6 is an expanded cross-sectional view of a disk assembly according to a second embodiment of the present invention;

FIG. 7 is a plan view of a leg portion in the second embodiment;

FIG. 8 is an expanded cross-sectional view of a disk assembly according to a third embodiment of the present invention;

FIG. 9 is a cross-sectional view taken along the line A-A' of FIG. 8;

FIG. 10 is an expanded cross-sectional view of a disk assembly according to a fourth embodiment of the present invention;

FIG. 11 is an expanded cross-sectional view of a disk assembly according to a fifth embodiment of the present invention;

FIG. 12 is an expanded cross-sectional view of a disk assembly according to a sixth embodiment of the present invention; and FIG. 13 is an expanded cross-sectional view of a disk assembly according to a seventh embodiment of the present invention.

DESCRIPTION OF SPECIFIC EMBODIMENTS

Hereafter, a disk assembly according to various embodiments of the present invention and a gas turbine including the same will be described in detail with reference to the accompanying drawings.

FIG. 1 is a cross-sectional view schematically illustrating an internal structure of a gas turbine 100 to which a disk assembly in accordance with an embodiment of the present invention is applied. The gas turbine 100 includes a housing 102 and a diffuser 106. The diffuser 106 is installed at the rear of the housing 102 to discharge combustion gas passed through the gas turbine 100. The gas turbine 100 further includes a combustor 104 disposed at the front of the diffuser 106, and the combustor 104 receives compressed air and combusts the received air.

Based on an air flow direction, a compressor section 110 is located in the upstream side of the housing 102, and a turbine section 120 is located in the downstream side of the housing 102. A torque tube 130 is disposed between the compressor section 110 and the turbine section 120, and the torque tube 130 serves as a torque transfer member to transfer torque generated by the turbine section 120 to the compressor section 110.

The compressor section 110 includes a plurality of compressor rotor disks 140 (for example, 14 compressor rotor disks), and the compressor rotor disks 140 are fastened by a tie bolt 150 so as not to be separated from each other in the axial direction.

Specifically, the compressor rotor disks 140 are aligned with each other along the axial direction, with the tie bolt 150 inserted through the central portions of the compressor rotor disks 140. The facing surfaces of the adjacent compressor rotor disks 140 are pressed against each other by the tie bolt 150, such that the compressor rotor disks 140 cannot rotate relative to each other.

The compressor rotor disk 140 has a plurality of blades 144 radially coupled to the outer circumferential surface thereof. Each of the blades 144 has a root part 146 fastened to the compressor rotor disk 140.

A vane (not illustrated) is disposed between the respective compressor rotor disks 140, and fixed to the housing. The vane is fixed not to rotate, unlike the compressor rotor disks. The vane serves to align a flow of compressed air passed through the blades of the compressor rotor disk, and guide the compressed air to the blades of another rotor disk located in the downstream side.

The root part 146 may be fastened in a tangential type or axial type. The root part 146 may be fastened through a fastening type which is selected according to a structure required by a gas turbine in common use, and have a dove-tail or fir-tree shape which is publicly known. In some cases, the blade may be fastened to the rotor disk through another fastener, for example, a key or bolt.

The tie bolt 150 is disposed through the central portions of the plurality of compressor rotor disks 140. One end of the tie bolt 150 is fastened to the inside of the compressor rotor disk located in the most upstream side, and the other end of the tie bolt 150 is fixed to the inside of the torque tube 130.

Since the tie bolt 150 may include various structures depending on the gas turbine, the shape of the tie bolt 150 is not limited to the shape illustrated in FIG. 1. That is, one tie bolt may be disposed through the central portions of the rotor disks as illustrated in FIG. 1, or a plurality of tie bolts may be arranged on the circumferences of the rotor disks. The two structures can be used together.

Although not illustrated, the compressor of the gas turbine may include a guide vane installed at the next position of the diffuser, in order to adjust a flow angle of fluid to a design flow angle, the fluid entering the entrance of the combustor after the pressure of the fluid was increased. The guide vane is referred to as a deswirler.

The combustor 104 mixes the introduced compressed air with fuel, combusts the fuel mixture to generate high-temperature high-pressure combustion gas with high energy, and raises the temperature of the combustion gas to the heat resistant limit which the parts of the combustor and the turbine can endure, through an isobaric combustion process.

The combustion system of the gas turbine may include a plurality of combustors in a casing formed in a cell shape, and each of the combustors includes a burner having a fuel injection nozzle and the like, a combustor liner constituting a combustion chamber, and a transition piece serving as a connection part between the combustor and the turbine.

Specifically, the liner provides a combustion space in which fuel injected by the fuel injection nozzle is mixed with compressed air of the compressor and then combusted. The liner may include a flame tube for providing the combustion space in which the fuel mixture is combusted and a flow sleeve for forming a ring-shaped space while surrounding the flame tube. The fuel injection nozzle is coupled to the front end of the liner, and an ignition plug is coupled to the sidewall of the liner.

The transition piece is connected to the rear end of the liner in order to transfer combustion gas combusted by the ignition plug toward the turbine. The outer wall of the transition piece is cooled by the compressed air supplied from the compressor, such that the transition piece is not damaged by the high-temperature combustion gas.

For this operation, the transition piece has cooling holes through which air can be injected to the inside, and the compressed air cools the main body in the transition piece through the cooling holes and then flows toward the liner.

The cooling air having cooled the transition piece may flow through the ring-shaped space of the liner, and compressed air may be provided as cooling air from the outside of the flow sleeve through the cooling holes of the flow sleeve, and collide with the outer wall of the liner.

The high-temperature high-pressure combustion gas coming out of the combustor is supplied to the turbine section 120. The supplied high-temperature high-pressure combustion gas is expanded to apply a driving force/reaction force to the rotating blades of the turbine, thereby generating torque. The generated torque is transferred to the compressor section 110 through the torque tube 130, and power exceeding the power required for driving the compressor is used to drive a generator or the like.

The turbine section 120 basically has a similar structure to the compressor section 10. That is, the turbine section 120 also includes a plurality of turbine rotor disks 180 similar to the compressor rotor disks 140 of the compressor section 110. Therefore, each of the turbine rotor disks 180 also includes a plurality of turbine blades 184 arranged in a radial shape. The turbine blades 184 may also be coupled to the turbine rotor disk 180 through dove tail-shaped parts or the like. Furthermore, a vane (not illustrated) is also disposed between the blades 184 of the turbine rotor disk 180 so as to be fixed to the housing, and guides a flow direction of combustion gas passing through the blades.

Referring to FIG. 2, the turbine rotor disk 180 has a circular plate shape, and includes a plurality of coupling slots 180*a* formed at the outer circumference thereof. The coupling slot 180*a* has an uneven surface, while having a fir tree-shaped cross-section.

The turbine blade 184 is fastened to the coupling slot 180*a*. In FIG. 2, the turbine blade 184 has a plate-shaped platform part 184*a* formed in the central portion thereof. The platform part 184*a* has a side surface which is in contact with a side surface of the platform part 184*a* of the adjacent turbine blade, and serves to maintain the space between the blades. The platform part 184*a* has a root part 184*b* formed at the bottom thereof. The root part 184*b* has a so-called axial-type structure that is inserted into the coupling slot 180*a* of the turbine rotor disk 180 along the axial direction of the turbine rotor disk 180.

The root part 184*b* has an uneven surface, while having a fir tree-shaped cross-section corresponding to the shape of the coupling slot 180*a*. The coupling structure of the root part 184*b* is not limited to the fir tree shape, but may have a dove tail shape.

The platform part 184*a* has a blade part 184*c* formed at the top thereof. The blade part 184*c* has a blade shape that is optimized according to the specification of the gas turbine, and includes a leading edge and a trailing edge. Based on the flow direction of combustion gas, the leading edge is disposed in the upstream side, and the trailing edge is disposed in the downstream side.

Unlike the blades of the compressor section, the blades of the turbine section come in direct contact with high-temperature high-pressure combustion gas. Since the temperature of the combustion gas is about 1,700° C., a cooling unit is required. For this structure, a cooling flow path is formed, which extracts compressed air from portions of the compressor section, and supplies the extracted gas toward the blades of the turbine section.

The cooling flow path may be extended outside the housing (external flow path) or extended through the rotor disks (internal flow path). The external and internal flow paths may be all used. In FIG. 2, the blade part 184*c* has a plurality of film cooling holes 184*d* formed on the surface thereof, and the film cooling holes 184*d* communicate with a cooling flow path (not illustrated) formed in the blade part 184*c*, and supplies cooling air to the surface of the blade part 184*c*.

Now, referring to FIG. 3, the disk assembly will be described in detail.

Referring to FIG. 3, the disk assembly includes three disks. The three disks have something in common in that they have a hole through which the tie bolt passes. However, while the first and second disks 210 and 220 have substantially the same shape, the third disk 230 has a smaller diameter than the first and second disks. Hereafter, each of the disks will be described in detail.

The first disk 210 has a T-shaped lateral cross-section. Specifically, the first disk 210 includes a disk body 214 and an outer rim 212. The outer rim 212 is formed on the outer circumference of the disk body 214 so as to protrude toward both sides along the axial direction of the tie bolt. The outer rim 212 is in contact with the adjacent disks, and couples the disks such that the disks cannot rotate relative to each other. For example, the outer rim 212 may have a friction surface coupled to the surface of the compressor rotor disk or the third disk by a pressing force of a fixing nut. Thus, the outer rim 212 may not slide with respect to the compressor rotor disk or the third disk. In addition, the outer rim 212 may have a plurality of protrusions formed on the surface thereof, through which the outer rim 212 is fastened to the adjacent disks.

One end of the disk body 214 of the first disk, facing the tie bolt 150, is separated from the surface of the tie bolt 150. Specifically, the first disk 210 has a cross-section of which the height is smaller than the width, based on FIG. 3. Therefore, the first disk 210 has an internal space formed around the tie bolt 150. The internal space forms a first air storage space S1 with a side space of the third disk. This structure will be described later.

The second disk 220 basically has a similar shape to the first disk 210. That is, the second disk 220 has a T-shaped lateral cross-sectional shape, and includes a disk body 224 and an outer rim 222 like the first disk 210. The outer rim 222 is formed on the outer circumference of the disk body 224 so as to protrude toward both sides along the axial direction of the tie bolt. The outer rim 222 of the second disk 220 is also in contact with the adjacent disks, and couples the disks such that the disks cannot rotate related to each other.

For example, the outer rim 222 may have a friction surface coupled to the surface of the turbine rotor disk or the third disk by the pressing force of the fixing nut. Thus, the outer rim 222 may not slide with respect to the turbine rotor disk or the third disk. In the second disk, the outer rim 222 may also have a plurality of protrusions formed on the surface thereof, through which the outer rim 222 is fastened to the adjacent disks.

The second disk forms a second air storage space S2 similar to the first air storage space S1 of the first disk 210.

The third disk has a different shape from the first and second disks. As illustrated in FIG. 3, the third disk 230 is formed in an I-shape, and includes a disk body 232 and an outer rim 236 formed outside the disk body 232 in the radial direction. The outer rim 236 may have the same shape as those of the first and second disks. The disk body 232 has a through-hole 232*a* extended along the longitudinal direction of the tie bolt 150.

The through-hole 232*a* functions as a flow path through which cooling air passes. FIG. 3 illustrates that the through-hole 232*a* is formed in parallel to the longitudinal direction of the tie bolt. However, the present embodiment is not limited thereto, but the through-hole 232*a* may include any shapes that are formed through the disk body 232.

For example, the through-hole 232*a* may be extended obliquely upward or downward, based on FIG. 3.

The third disk 230 also has a hole formed in the central portion thereof, through which the tie bolt passes, and the hole has a smaller inner diameter than those of the first and second disks. Therefore, as illustrated in FIG. 3, the first and second air storage spaces S1 and S2 are defined at respective sides of the disk body 232 of the third disk 230. The first and second air storage spaces S1 and S2 are defined by the internal spaces of the first and second disks and the spaces formed at both sides of the disk body of the third disk.

The first air storage space S1 disposed between the first and third disks functions as a space in which cooling air extracted from the compressor section is primarily stored. The second air storage space S2 functions as a space in which cooling air to be injected to the turbine section temporarily stays.

The through-hole 232*a* serves to connect the two air storage spaces S1 and S2 with each other. Therefore, the cooing air stored in the first air storage space S1 may be introduced into the second air storage space S2 through the through-hole 232*a*. The introduced cooling air is temporarily stored in the second air storage space S2, and then supplied toward the turbine section.

The hole 238 formed in the third disk 230 has a plurality of legs 234 formed on the inner surface thereof (refer to FIG. 4). The legs 234 are placed against the outer circumferential surface of the tie bolt 150, and keep the third disk 230 from moving in the radial direction.

Referring to FIG. 4, six legs 234 are radially arranged around the center of the third disk 230. Between the respective legs 234, a space 235 is formed. The space 235 is extended through the third disk in the axial direction, and forms a flow path of cooling air with the above-described through-hole 232*a*. Thus, since the third disk is supported by direct contact with the tie bolt, the third disk can be stably supported by the tie bolt, and the space 235 formed between the legs can provide a satisfactory air flow path.

The space 235 is formed in a semi-circular shape, but the present embodiment is not limited thereto. For example, as illustrated in FIG. 5, the space 235 may have a rectangular cross-section. In addition, the space 235 may have various shapes through which air can be passed.

The legs 234 are extended along the longitudinal direction of the tie bolt, and radially arranged around the tie bolt. Thus, the third disk can be stably and reliably supported by the surface of the tie bolt.

The leg may be modified into a shape illustrated in FIGS. 6 and 7. FIGS. 6 and 7 illustrate a disk assembly according to a second embodiment of the present invention. In the following descriptions, the same components as those of the first embodiment are represented by like reference numerals, and the duplicated descriptions are omitted.

Basically, the second embodiment has the same structure as the first embodiment, except for the shape of the leg. In the second embodiment, the legs 234 are also radially formed on the inner circumferential surface of the hole 238. However, each of the legs 234 has support parts 232*b* formed at both sides thereof and extended in the circumferential direction of the tie bolt.

The support parts 232*b* and the leg 234 are in direct contact with the surface of the tie bolt, while supporting the third disk. Therefore, since the contact area between the third disk and the tie bolt is increased by the area of the support parts, the third disk can be more stably supported.

In the first and second embodiments, the third disk is supported by the direct contact with the tie bolt, and the coupling between the first and second disks and the third disk is maintained by the axial pressure of the tie bolt. That is, the first to third disks are supported by the legs in the radial direction. In some cases, an example in which a tension ring is used as a damping unit between the third disk and the tie bolt 150 may be considered, the damping unit serving to suppress radial vibrations of the first to third disks.

FIGS. 8 and 9 illustrate a disk assembly having a tension ring 250 according to a third embodiment of the present invention. The tension ring 250 is made of an arbitrary material with elasticity, and has a cross-sectional shape of which the top is supported by contact with the leg 234 and the bottom is supported by contact with the outer circumferential surface of the tie bolt 150, based on FIG. 8. Therefore, the tension ring 250 can absorb vibrations which may be generated in operation, thereby preventing a reduction in lifetime of a device while minimizing an occurrence of noise.

FIG. 8 illustrates that the tension ring 250 is installed only in the third disk 230. This is because, since the three disks are fixed between the compressor section and the turbine section in the axial direction by the tie bolt, vibrations can be sufficiently absorbed only by one tension ring.

In the above-described embodiments, the I-shaped disk is disposed between the two T-shaped disks. However, the number of disks and the arrangement order may be arbitrarily changed. Furthermore, the first and second disks are separated from each other, and supported through the third disk. However, in order to improve the vibration absorption performance, an additional member may be installed to connect the first and second disks.

FIG. 10 illustrates a disk assembly according to a fourth embodiment of the present invention. Referring to FIG. 10, the disk assembly 1200 includes three disks. The three disks have something in common in that they have a hole through which the tie bolt passes. However, while the first and second disks 1210 and 1230 have substantially the same shape, the third disk 1220 has a through-hole 1224*a* for providing a flow path through which cooling air passes. Hereafter, each of the disks will be described in detail.

The first disk 1210 has a T-shaped lateral cross-section. Specifically, the first disk 1210 includes a disk body 1214 and an outer rim 1212. The outer rim 1212 is formed at an outer end of the disk body 1214 in the radial direction, and protrudes toward both sides along the axial direction of the tie bolt. The outer rim 1212 is in contact with the adjacent disks, and couples the disks such that the disks cannot rotate relative to each other. For example, the outer rim 1212 may have a friction surface coupled to the surface of the compressor rotor disk or the third disk by the pressing force of the fixing nut. Thus, the outer rim 1212 may not slide with respect to the compressor rotor disk or the third disk. In addition, the outer rim 1212 may have a plurality of protrusions formed on the surface thereof, through which the outer rim 1212 is fastened to the adjacent disks.

One end of the disk body 1214 of the first disk 1210, facing the tie bolt 150, is separated from the surface of the tie bolt 150. Therefore, a gap S11 is formed between the surface of the tie bolt 150 and the end of the disk body 1214. The gap will be described later.

The first disk 1210 further includes an inner rim 1215 formed between the tie bolt 150 and the outer rim 1212 or at the central portion of the disk body 1214. The inner rim 1215 is formed only at one side surface of the left and right side surfaces of the first disk 1210, the one side surface corresponding to the opposite side of the compressor section. Like the outer rim 1212, the inner rim 1215 is coupled to an adjacent inner rim so as to transfer torque between the respective disks, thereby more stably supporting the disks in the axial direction.

The second disk 1230 basically has a similar shape to the first disk 1210. That is, the second disk 1230 has a T-shaped lateral cross-sectional shape, and includes a disk body 1234 and an outer rim 1232 like the first disk 1210. The outer rim 222 is formed at an outer end of the disk body 1234, and protrudes toward both sides along the axial direction of the tie bolt. The outer rim 1232 of the second disk 1230 is also in contact with the adjacent disks, and couples the disks such that the disks cannot rotate relative to each other.

For example, the outer rim 1232 may have a friction surface coupled to the surface of the turbine rotor disk or the third disk by the pressing force of the fixing nut. Thus, the outer rim 1232 may not slide with respect to the turbine rotor disk or the third disk. In the second disk 1230, the outer rim 1232 may also have a plurality of protrusions formed on the surface thereof, through which the outer rim 1232 is fastened to the adjacent disks. Furthermore, a gap S13 similar to the gap S11 of the first disk 1210 is disposed at the tie bolt-side end of the second disk.

The second disk 1230 also includes an inner rim 1235 formed between the tie bolt 150 and the outer rim 1232 or at the central portion thereof. The inner rim 1235 is formed only at one side surface of the left and right side surfaces of the second disk 1230, the one side surface corresponding to the opposite side of the turbine section. The inner rim 1235 is coupled to the adjacent inner rim so as to transfer torque between the respective disks, thereby more stably supporting the disks in the axial direction.

The third disk has a different shape from the first and second disks. As illustrated in FIG. 10, the third disk 1220 has something in common with the first and second disks in that the third disk 1220 has a T-shaped structure. Therefore, the third disk 1220 includes an outer rim 1222 like the first and second disks, and the outer rim 1222 is coupled to the outer rims of the first and second disks. Therefore, torque generated by the turbine section may be transferred to the compressor section through the second, third and first disks.

Furthermore, the third disk 1220 includes a disk body 1224 which is extended downward from the center of the outer rim 1222 and has a through-hole 1224*a* extended along the longitudinal direction of the tie bolt 150. The through-hole 1224*a* functions as a flow path through which cooling air passes. FIG. 10 illustrates that the through-hole 1224*a* is formed in parallel to the longitudinal direction of the tie bolt 150. However, the present embodiment is not limited thereto, but the through-hole 1224*a* may include any shapes that are formed through the disk body 1224.

For example, the through-hole 1224*a* may be tilted toward the gap S13 of the second disk 1230.

Between the outer rim 1222 of the third disk 1220 and the tie bolt, the inner rim 1225 is formed. The inner rim 1225 formed in the third disk 1220 is formed at each of the left and right side surfaces of the third disk 1220, unlike the first and second disks. Therefore, the inner rims formed in the first to third disks may be aligned in a line, and engaged with each other to transfer torque.

The disk body 1224 of the third disk 1220 has first and second spaces formed at both sides thereof. Specifically, the first spaces are disposed at both sides of the third disk 1220 and at the inner side in the radial direction. One of the two first spaces is defined by the tie bolt 150, the inner rims 1215 and 1225 of the first and third disks and the disk bodies 1214 and 1224 of the first and third disks, and the other of the two first spaces is defined by the tie bolt 150, the inner rims 1235 and 1225 of the second and third disks and the disk bodies 1234 and 1224 of the second and third disks.

The first space disposed between the first and second disks functions as a space in which cooling air supplied from the compressor section is primarily stored. The first space communicates with the gap S11 of the first disk. Through this structure, cooling air extracted from the compressor section may be temporarily stored in the first space.

The through-hole 1224*a* serves to connect the two first spaces with each other. Therefore, the cooing air stored in the one of the two first spaces may be introduced into the other of the two first spaces through the through-hole 1224*a*. The introduced cooling air is temporarily stored in the other of the two first spaces, and then supplied toward the turbine section through the gap S13 of the second disk 1230.

The gap S13 formed in the second disk 1230 functions as a nozzle for discharging the air stored in the first space to the turbine section. The air stored in the first space has a higher pressure than the atmosphere, because the air was supplied from the compressor section as described above. Therefore, the air may be injected toward the turbine by the pressure, thereby cooling the turbine.

In order to raise the cooling efficiency, the gap S13 may be tilted toward a specific portion of the turbine section.

Furthermore, a second space is formed between the inner rims and the outer rims of the first and third disks and between the inner rims and the outer rims of the second and third disks. The second space is disposed at the outer side in the radial direction from the first space, and does not communicate with the first space. Therefore, the cooling air can flow only through the first space, and is not transferred to the second space.

As described above, the first to third disks are supported by the outer rims and the inner rims, and the second space is disposed between the outer rims and the inner rims. Since two disks are fixed to each other at locations separated from each other, torque can be stably transferred. The second space may function as a weight reduction part that reduces the weight of the torque transfer member.

In the disk assembly according to the fourth embodiment, the coupling of the three disks having end portions facing the tie bolt 150 is maintained by the axial pressure of the tie bolt 150. At this time, in order to support the first to third disks in the radial direction, a tension ring 1250 is inserted between the end portion of the third disk and the tie bolt 150.

The tension ring 1250 is made of an arbitrary material with elasticity, and has a cross-sectional shape of which the top is supported by contact with the disk body 1224 of the third disk 1220 and the bottom is supported by contact with the outer circumferential surface of the tie bolt 150, based on FIG. 10. Therefore, the tension ring 1250 can absorb vibrations which may be generated in operation, thereby preventing a reduction in lifetime of the device while minimizing an occurrence of noise.

FIG. 10 illustrates that the tension ring is installed only in the third disk. This is because, since the three disks are fixed between the compressor section and the turbine section in the axial direction by the tie bolt, vibrations can be sufficiently absorbed only by one tension ring, while cooling air can be controlled to flow through the first and second disks. In some cases, however, the tension ring may be installed in both of the first and second disks, and the through-hole 1224*a* may also be formed in both of the first and second disks, in order to provide a sufficient amount of cooling air while further increasing the vibration absorption performance.

In the present embodiment, the three disks have the T-shaped structure in which the upper end portions of the disk bodies having substantially the same size are extended left and right in the axial direction. However, the three disks may have a structure in which a T-shaped disk is disposed between two I-shaped disks. In this case, the number of disks and the arrangement order can be arbitrarily changed. Furthermore, the first and second disks are separated from each other, and supported by each other through the third disk. However, in order to improve the vibration absorption performance, an additional member may be installed to connect the first and second disks.

FIG. 11 illustrates a disk assembly according to a fifth embodiment of the present invention. In the fifth embodiment, the same components as those of the fourth embodiment are represented by like reference numerals, and the duplicated descriptions are omitted herein.

The disk assembly according to the fifth embodiment of FIG. 11 includes disks similar to those of the fourth embodiment. The disk assembly according to the fifth embodiment includes two first and second disks 1210 and 1230 having an I-shaped cross-section, and the first and second disks 1210 and 1230 include outer rims 1212 and 1232 and disk bodies 1214 and 1234, respectively.

The third disk 1220 includes an outer rim 1222 and a disk body 1224 integrated with the outer rim. Specifically, the outer rim 1222 is formed at an outer end of the disk body 1224 in the radial direction. The disk body 1224 has a through-hole 1224*a* functioning as a flow path through which cooling air flows. The first to third disks include inner rims having the same structure as those of the fourth embodiment. In other words, the third disk according to the fifth embodiment has the same structure as the third disk according to the fourth embodiment.

In the case of the first and second disks, however, two gaps S11 and S13 formed between the disk bodies and the tie bolt are formed differently from those of the fourth embodiment. In other words, the disk bodies 1214 and 1234 in the first and second disks have a smaller radial length than the disk body 1224 of the third disk. Therefore, as illustrated in FIG. 11, the gaps are extended to the inner surfaces of the inner rims formed in the first and second disks. In other words, the disk bodies of the first and second disks are separated from the tie bolt so as to face the tie bolt. This structure can pass cooling air more smoothly.

In the fifth embodiment, since the gaps of the first and second disks are expanded, the support force for the first and second disks is likely to be reduced, compared to the fourth embodiment. However, since the first and second disks are double supported by the inner rims and the outer rims, a support force capable of guaranteeing stability can be secured even though the gaps are expanded.

FIG. 12 is a cross-sectional view illustrating a disk assembly according to a sixth embodiment of the present invention. Referring to FIG. 12, the disk assembly 2200 includes three disks. The three disks have something in common in that they have a hole through which the tie bolt passes. However, while the first and second disks 2210 and 2230 have substantially the same shape, the third disk 2220 has a through-hole 2224*a* for providing a flow path through which cooling air passes. That is, without the through-hole, the first to third disks may have the same shape.

Hereafter, each of the disks will be described in detail.

The first disk 2210 has a T-shaped lateral cross-section. Specifically, the first disk 2210 includes a disk body 2214 and an outer rim 2212. The outer rim 2212 is formed on the outer circumference of the disk body 2214 so as to protrude toward both sides along the axial direction of the tie bolt. The outer rim 2212 is in contact with the adjacent disks, and couples the disks such that the disks cannot rotate relative to each other. For example, the outer rim 2212 may have a friction surface coupled to the surface of the compressor rotor disk or the third disk by the pressing force of the fixing nut. Thus, the outer rim 2212 may not slide with respect to the compressor rotor disk or the third disk. Besides, the outer rim 2212 may have a plurality of protrusions formed on the surface thereof, through which the outer rim 2212 is fastened to the adjacent disks.

One end of the disk body 2214 of the first disk 2210, facing the tie bolt 150, is separated from the surface of the tie bolt 150. Therefore, a gap S22 is formed between the surface of the tie bolt 150 and the end of the disk body 2214. The space will be described later.

The second disk 2230 basically has a similar shape to the first disk 2210. That is, the second disk 2230 has a T-shaped lateral cross-section, and includes a disk body 2234 and an outer rim 2232 like the first disk 2210. The outer rim 2232 is formed on the outer circumference of the disk body 2234 so as to protrude toward both sides along the axial direction of the tie bolt. The outer rim 2232 of the second disk 2230 is also in contact with the adjacent disks, and couples the disks such that the disks cannot rotate relative to each other.

For example, the outer rim 2232 may have a friction surface coupled to the surface of the turbine rotor disk or the third disk by the pressing force of the fixing nut. Thus, the outer rim 2212 may not slide with respect to the compressor rotor disk or the third disk. In the second disk, the outer rim 2232 may also have a plurality of protrusions formed on the surface thereof, through which the outer rim 2232 is fastened to the adjacent disks. Furthermore, a gap S22 similar to the gap S22 of the first disk 2210 is disposed at the tie bolt-side end of the second disk 2230.

The third disk has a different shape from the first and second disks. As illustrated in FIG. 12, the third disk 2220 has something in common with the first and second disks in that the third disk 2220 has a T-shaped structure. Therefore, the third disk 2220 includes an outer rim 2222 like the first and second disks, and the outer rim 2222 is coupled to the outer rims of the first and second disks. Therefore, torque generated by the turbine section may be transferred to the compressor section through the second, third and first disks.

Furthermore, the third disk 2220 includes a disk body 2224 which is extended downward from the center of the outer rim 2222, and has a through-hole 2224*a* extended along the longitudinal direction of the tie bolt 150. The through-hole 2224*a* functions as a flow path through which cooling air passes. FIG. 12 illustrates that the through-hole 2224*a* is formed in parallel to the longitudinal direction of the tie bolt 150. However, the present embodiment is not limited thereto, but the through-hole 2224*a* may include any shapes that are formed through the disk body 2224.

For example, the through-hole 2224*a* may be tilted toward the gap S22 of the second disk 2230.

The third disk 2220 has first and second air storage spaces S21 defined at both sides of the disk body 2224, as an example of the first space. Both side surfaces of the first and second air storage spaces S21 are defined by the disk bodies, the top surfaces thereof are defined by the outer rims, and the bottom surfaces thereof are defined by the surface of the tie bolt.

The first air storage space S21 disposed between the first and second disks functions as a space in which cooling air supplied from the compressor section is primarily stored. The first air storage space S21 communicates with the gap S22 of the first disk 2210. Through this structure, the cooling air extracted from the compressor section may be temporarily stored in the first air storage space S21.

The through-hole 2224*a* serves to connect the two air storage spaces S21 with each other. Therefore, the cooing air stored in the first air storage space S21 may be introduced into the second air storage space S21 through the through-hole 2224*a*. The introduced cooling air is temporarily stored in the second air storage space, and then supplied toward the turbine section through the gap S22 of the second disk 2230.

The gap S22 formed in the second disk 2230 functions as a nozzle for discharging the air stored in the second air storage space S21 to the turbine section. The air stored in the air storage space has a higher pressure than the atmosphere, because the air was supplied from the compressor section as described above. Therefore, the air may be injected toward the turbine by the pressure, thereby cooling the turbine. In order to raise the cooling efficiency, the gap S22 may be tilted toward a specific portion of the turbine section.

The first and second air storage spaces S21 communicate with the second spaces formed in the compressor section and the turbine section, respectively. That is, the second space formed in the compressor section and the first air storage space are disposed at both side surfaces of the first disk, and the second space formed in the turbine section and the second air storage space are disposed at both side surfaces of the second disk. (If FIG. 12 is amended to indicate the second space, please insert the reference corresponding to the second space.)

Through this structure, two cooling air storage spaces may be disposed at both side surfaces of the third disk, and function as buffers for smoothly supplying cooling air.

In the sixth embodiment of the disk assembly, the coupling of the three disks having end portions facing the tie bolt 150 is maintained by the axial pressure of the tie bolt 150. At this time, in order to support the first to third disks in the radial direction, a tension ring 2240 is inserted between the end portion of the third disk 2220 and the tie bolt 150.

The tension ring 2240 is made of an arbitrary material with elasticity, and has a cross-sectional shape of which the top is supported by contact with the disk body 2224 and the bottom is supported by contact with the outer circumferential surface of the tie bolt 150, based on FIG. 12. Therefore, the tension ring 2240 can absorb vibrations which may be generated in operation, thereby preventing a reduction in lifetime of the device while minimizing an occurrence of noise.

FIG. 12 illustrates that the tension ring is installed only in the third disk. This is because, since the three disks are fixed between the compressor section and the turbine section in the axial direction by the tie bolt, vibrations can be sufficiently absorbed only by one tension ring, while cooling air can be controlled to flow through the first and second disks. In some cases, however, the tension ring may be installed in both of the first and second disks, and the through-hole 2224*a* may also be formed in both of the first and second disks, in order to provide a sufficient amount of cooling air while further increasing the vibration absorption performance.

In the present embodiment, all of the three disks have the T-shaped structure. However, the disk assembly may have a structure in which one I-shaped disk is disposed between two T-shaped disks. In this case, the number of disks and the arrangement order may be arbitrarily changed. Furthermore, the first and second disks are separated from each other, and supported by each other through the third disk. However, in order to improve the vibration absorption performance, an additional member may be installed to connect the first and second disks.

FIG. 13 illustrates a disk assembly according to a seventh embodiment of the present invention. In the seventh embodiment, the same components as those of the sixth embodiment are represented by like reference numerals, and the duplicated descriptions are omitted herein.

The disk assembly according to the seventh embodiment of FIG. 13 includes disks similar to those of the sixth embodiment. Thus, the disk assembly according to the seventh embodiment includes first and second disks 2310 and 2330 having a T-shaped cross-section, and the first and second disks include outer rims 2312 and 2332 and disk bodies 2314 and 2334, respectively.

The third disk 2320 includes an outer rim 2322 and a disk body 2324 integrated with the outer rim 2322. The disk body 2324 has a through-hole 2324*a* functioning as a flow path through which cooling air flows. The third disk 2320 has an inner rim 2326 formed at an inner end of the disk body 2324 in the radial direction. The inner rim 2326 is extended from both side surfaces of the disk body 2324 so as to protrude along the tie bolt.

The inner rim 2326 not only improves the stiffness of the third disk 2320, but also guides cooling air passed through the through-hole 2324*a*. That is, the top surface of the inner rim 2326 is formed as a tapered surface that is tilted along the flow direction of the cooling air.

Therefore, the cooling air may be naturally introduced into the through-hole 2324*a* while flowing along the tapered surface, and discharged from the through-hole 2324*a*.

While the present invention has been described with respect to the specific embodiments, it will be apparent to those skilled in the art that various changes and modifications may be made without departing from the spirit and scope of the invention as defined in the following claims.

What is claimed is:

1. A disk assembly comprising:

a first disk engaged with a compressor section of a gas turbine;

a second disk engaged with a turbine section of the gas turbine; and a third disk disposed between the first and second disks, and transferring torque applied to the second disk to the first disk, wherein each of the first to third disks comprises a disk body through which a tie bolt of the gas turbine passes, and an outer rim formed on an outer circumference of the disk body and coupling the disks to each other such that the disks cannot rotate relative to each other, and wherein the disk body of the third disk has first and second spaces formed at respective sides of the third disk, and the first and second spaces communicate with each other through a through-hole formed in the disk body of the third disk.

2. The disk assembly of claim 1, wherein the third disk has a plurality of legs formed on an inner circumferential surface thereof, the plurality of legs being in contact with an outer circumferential surface of the tie bolt.

3. The disk assembly of claim 2, wherein the legs are radially arranged around a center of the third disk.

4. The disk assembly of claim 1, wherein the through-hole of the third disk is disposed between the outer rim and an inner circumferential surface.

5. The disk assembly of claim 1, wherein the first and second disks have an inner circumferential surface separated from the tie bolt, and the inner circumferential surface is disposed at an outer side of the through-hole of the third disk in a radial direction.

6. The disk assembly of claim 2, wherein at least one of the plurality of legs comprises support parts extended from both side surfaces thereof in a circumferential direction.

7. The disk assembly of claim 6, wherein a cooling air flow path is formed between the respective legs.

8. The disk assembly of claim 7, wherein the cooling air flow path is formed through the third disk in an axial direction.

9. The disk assembly of claim 1, wherein gaps are formed between the first and second disks and the tie bolt, respectively, and the gaps communicate with the first and second spaces.

10. The disk assembly of claim 1, wherein the third disk has an inner rim formed at an inner side thereof in a radial direction, the inner rim being extended in a longitudinal direction of the tie bolt.

11. The disk assembly of claim 10, wherein the inner rim has a tilted surface.

12. The disk assembly of claim 10, wherein each of the first and second disks comprises an inner rim which is in contact with the inner rim of the third disk, and a third space is formed by the inner rims, the outer rims, and the disk bodies.

13. The disk assembly of claim 12, wherein the third space is formed at both sides of the third disk.

14. The disk assembly of claim 13, wherein the third space is blocked from the first and second spaces by the inner rims.

15. A disk assembly comprising first to third disks coupled to each other along an axial direction of a tie bolt so as not to rotate relative to each other;

wherein the first and second disks have a gap with the tie bolt, and the third disk has a through-hole which is formed therethrough and not in contact with the tie bolt, and wherein the gaps of the first and second disks and the through-hole of the third disk provide a cooling air flow path passing through the first to third disks.

16. The disk assembly of claim 15, wherein the third disk is disposed between the first and second disks, the first disk is coupled to a compressor section of a turbine, and the second disk is coupled to a turbine section of the turbine.

17. The disk assembly of claim 15, wherein the third disk has first and second spaces formed at respective sides thereof, the first and second spaces communicating with each other through the through-hole.

18. A gas turbine comprising:

a housing having a diffuser installed at one end thereof;

a compressor section disposed in the housing;

a turbine section disposed in the housing;

a tie bolt rotatably supporting the compressor section and the turbine section; and a disk assembly disposed between the compressor section and the turbine section, and transferring torque generated by the turbine section to the compressor section, wherein the disk assembly comprises:

a first disk engaged with the compressor section;

a second disk engaged with the turbine section; and a third disk disposed between the first and second disks, and transferring torque applied to the second disk to the first disk, wherein each of the first to third disks comprises a disk body through which the tie bolt passes, and an outer rim formed on an outer circumference of the disk body and coupling the disks to each other such that the disks cannot rotate relative to each other, and wherein first and second spaces are formed at respective sides of the disk body of the third disk, communicate with each other through a through-hole formed in the disk body of the third disk, and form a cooling air flow path extended from the compressor section to the turbine section.

19. The gas turbine of claim 18, wherein the first space functions as a chamber for temporarily storing cooling air supplied from the compressor section.

20. The gas turbine of claim 18, wherein the second space functions as a chamber for temporarily storing cooling air to be supplied to the turbine section.

* * * * *